US006364235B1

(12) United States Patent
Wahhoud

(10) Patent No.: US 6,364,235 B1
(45) Date of Patent: Apr. 2, 2002

(54) WEFT PRE-SPOOLING DEVICE FOR AIR JET LOOM

(75) Inventor: Adnan Wahhoud, Lindau/Bodolz (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/658,316

(22) Filed: Sep. 8, 2000

(30) Foreign Application Priority Data

Sep. 11, 1999 (DE) ..... 199 43 609

(51) Int. Cl.[7] ..... B65H 51/20; D03D 47/36

(52) U.S. Cl. ..... 242/365.5; 139/452; 242/364.8; 242/365.1

(58) Field of Search ..... 242/364.8, 365.1, 242/365.5, 365.3, 365.4; 139/452

(56) References Cited

U.S. PATENT DOCUMENTS 5,069,395 A 12/1991 Krumm

FOREIGN PATENT DOCUMENTS

DE 3534599 4/1986

*Primary Examiner*—Michael R. Mansen
(74) *Attorney, Agent, or Firm*—W. F. Fasse; W. G. Fasse

(57) ABSTRACT

A weft thread pre-winder or pre-spooling device for an air jet loom includes a thread storage drum (6) made up of several drum segments (7) that are each adjustable in the radial direction so as to adjust the diameter and circumference of the thread storage drum. Thereby the amount of stored thread can be adjusted. Open gaps or interspaces (8) are formed between respective adjacent drum segments (7), and become larger or smaller depending on the radial adjustment of the segments. Especially for threads that form only a small thread balloon while being drawn-off from the thread storage drum, the threads would tend to get into these interspaces and become caught on the edges or corners of the drum segments, which would lead to energy losses in the thread and interfere with the proper weft insertion and thread transport. To prevent these problems, a protective disk (10) is fixedly or rotatably arranged on or near the endface of the drum (6) on the drawing-off side thereof, and the weft thread (2) is drawn over the outer circumferential edge of the disk (10), which thus prevents the threads from getting into the interspaces (8). The diameter of the disk (10) is substantially matched to the adjusted diameter of the drum segments (7).

22 Claims, 5 Drawing Sheets

WEFT PRE-SPOOLING DEVICE FOR AIR JET LOOM

PRIORITY CLAIM

This application is based on and claims the priority under 35 U.S.C. §119 of German Patent Application 199 43 609.6, filed on Sep. 11, 1999, the entire disclosure of which is incorporated herein by reference.

FIELD OF THE INVENTION

The invention relates to a pre-spooling device or pre-winder for the weft thread in an air jet loom, including a weft thread storage drum consisting of plural drum segments that are each adjustable in a radial direction. The weft thread is wound onto the drum segments by a thread guide cooperating with a drive shaft, and is then drawn of f from the drum segments by the weft insertion means that carry the weft into the loom shed.

BACKGROUND INFORMATION

It is generally known to provide weft pre-spooling devices, also known as weft thread stores, for air jet looms, to continuously draw-off the weft thread from the main supply spool, and to make ready a predetermined adjustable length of yarn or thread for each weft insertion of the weft thread into the loom shed. In practice, it is known to use pre-spooling devices with so-called drum stores, for example as disclosed in German Patent Laying-Open Document 35 34 599, published on Apr. 30, 1986. Typically, as disclosed in this reference, the proper length of weft thread is preselected, wound up on a drum, and then intermediately stored on this drum. The weft insertion length is determined by the circumference of the drum multiplied by the number of windings or turns of the weft thread around the drum as provided for each respective weft insertion.

Thus, the length of weft thread provided for each weft insertion can be adjusted in discrete steps by adjusting the number of turns or windings of the weft thread provided on the drum. A further possibility of adjusting the weft insertion length is provided in that the drum consists of plural drum segments distributed about the circumference of the drum. The drum segments are each radially adjustable, whereby a radial sliding adjustment of the drum segments changes the diameter and the circumference of the drum, which thereby also changes the length of each winding or turn of thread and consequently adjusts the total weft insertion length provided by a prescribed plurality of such thread windings. Interspaces or gaps are formed between the successive drum segments distributed about the circumference of the drum, whereby these interspaces become larger or smaller depending on the radial adjustment of the drum segments.

The action of drawing the weft thread off of the drum during the weft insertion forms a so-called thread balloon between the draw-off region of the thread leaving the drum and a drawing-off eye or eyelet arranged downstream thereof. The drawing-off eyelet can be arranged in a so-called balloon breaker or anti-ballooning device, which limits the formation and radially outward extent of the balloon. Alternatively, the drawing-off eyelet can be mounted on a separate holder bracket or can be connected directly to the weft insertion nozzle.

The form or shape of the thread balloon depends on various parameters. The thread characteristics have a considerable influence on the formation of the thread balloon. For example, smooth filament yarns lead to the formation of a larger thread balloon, whereby it is advantageous for the weft insertion to limit the formation of such a larger thread balloon by means of the balloon breaker or anti-ballooning device. Voluminous yarns or yarns with a band-shaped or ribbon-shaped cross-section, however, exhibit a higher form resistance in the air and in the rotation direction, whereby a smaller thread balloon is typically formed. In that case, the thread has a tendency to enter into the open interspaces or gaps between the drum segments during the drawing-off of the thread from the drum. The thread then collides with or catches on the rounded edges or corner portions of the respective drum segments as the thread is unwound from the drum.

When the thread enters the interspaces in the above mentioned manner, this causes energy losses in the thread during the weft insertion and during the transport of the thread across the weft thread insertion length. Furthermore, that also causes interferences in the proper insertion and transport of the weft thread, which in turn tends to increase the time window or time spread during which the weft thread will arrive at the downstream or arrival side of the loom. This increases the difficulty of detecting whether a weft fault has occurred. In order to ensure the proper and trouble-free operation of the loom in this case, a higher energy must be applied to the thread, and/or the rotational speed of the loom must be decreased. Both of these measures have a negative influence on the efficiency of the loom and the weaving process.

SUMMARY OF THE INVENTION

In view of the above, it is an object of the invention to provide a weft pre-spooling device or pre-winder of the above mentioned general type, which is improved in such a manner so as to achieve the interference-free drawing-off of the weft thread, and particularly a weft thread having a high inherent form resistance, so as to avoid the above mentioned disadvantageous effects on the operation of the loom. Particularly, it is an object of the invention to provide such a pre-spooling device from which the weft thread can be smoothly drawn off, without becoming caught in the open interspaces or gaps between adjacent drum segments. The invention further aims to avoid or overcome the disadvantages of the prior art, and to achieve additional advantages, as are apparent from the present specification.

The above objects have been achieved according to the invention in a pre-spooling device including a weft storage drum comprising a plurality of drum segments that are each adjustable in a radial direction, a thread guide that is connected to a drive shaft and is adapted to wind weft thread onto the storage drum, and a protective disk arranged in the area of the downstream or drawing-off endface of the drum. A weft insertion mechanism is adapted to draw the weft thread off of the storage drum and carry it into the loom shed. The protective disk is arranged so that the weft thread is drawn off over the circumferential edge of the protective disk.

The key concept of the invention is to prevent the penetration of the weft thread into the open gaps or interspaces between the successive drum segments by arranging the rotationally symmetrical protective disk in the area of the downstream or drawing-off side endface of the drum. The weft thread is then drawn off over the circumferential edge of this protective disk. This arrangement makes sure that the weft thread is held away from the circumference of the storage drum, especially near the downstream end thereof, and thereby prevents the thread from penetrating into the open gaps between adjacent drum segments or becoming caught on the free edges of the drum segments.

Preferably, the diameter of the protective disk corresponds approximately to the respective prevailing diameter of the drum, i.e. the diameter to which the drum segments are adjusted at a given time. Due to the possible diameter variation of the drum as the result of the radial adjustment of the drum segments, the invention further provides for an exchangeable set of protective disks having respective different diameters. Thus, the particular protective disk is exchangeable to match the adjusted diameter of the storage drum. Also, the axial spacing distance of the protective disk away from the endface of the storage drum is adjustable. By the above measures, the diameter of the disk can be adapted to the actual presently existing diameter of the drum.

In order to reduce the frictional resistance between the weft thread and the protective disk, the circumferential edges of the protective disk are rounded-off. Moreover, preferably the edge or perimeter surfaces of the protective disk have a selected surface roughness or smoothness characteristic in a range from rough to smooth, depending on and corresponding to the quality of the yarn that is to be processed.

In a first example embodiment, the protective disk is connected rigidly to a non-rotating part of the pre-spooling device or pre-winder, for example, such as the drum of the pre-spooling device. Thus, the protective disk is stationary or fixedly arranged and the weft thread glides over the outer perimeter surface of the protective disk while it is being drawn off. In order to further reduce the frictional resistance between the weft thread and the protective disk, a second example embodiment provides that the protective disk is rotatably driven to rotate about its center axis, whereby the protective disk is connected to the drum or to the drive shaft of the thread guide. In this context, the rotational direction of the protective disk corresponds to the rotational direction of the thread guide. In other words, the rotational direction of the protective disk is the same as that of the rotating elements of the pre-spooling device. In this manner, the frictional resistance can be substantially reduced, which is especially advantageous when sensitive yarns are being processed. Preferably, the rotational speed of the protective disk is adjustable, so that it can be adapted or matched to the drawing-off speed of the yarn.

A variation of the drive mechanism is that the protective disk is rotationally driven by wings or vanes that are arranged on the protective disk, whereby an appropriately arranged blowing nozzle blows a pressure medium against these wings or vanes in a tangential or circumferential direction so as to rotationally drive the protective disk. In a second variation of the drive mechanism for the protective disk, the disk is driven directly by the drive shaft which also rotatingly drives the thread guide. In a third drive variation, the protective disk is driven by an electric motor, which is arranged rigidly on a non-rotating part of the pre-spooling device, such as the drum, for example.

Preferably, the protective disk essentially consists of or comprises a light metal alloy such as an aluminum alloy, or a synthetic plastic that is provided with a hard coating.

BRIEF DESCRIPTION OF THE DRAWINGS

In order that the invention may be clearly understood, it will now be described in connection with example embodiments, with reference to the accompanying drawings, wherein.

DESCRIPTION OF PREFERRED EXAMPLE EMBODIMENTS AND OF THE BEST MODE OF THE INVENTION

Figure 1:
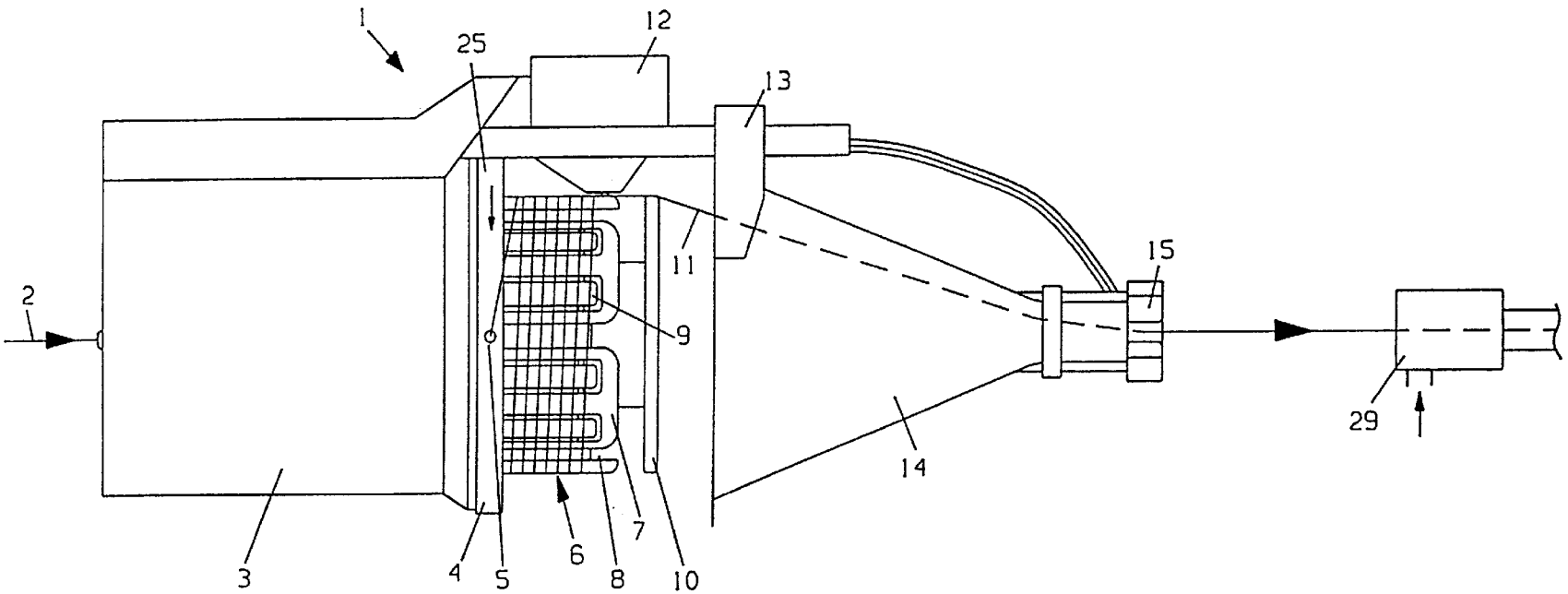
FIG. 1 is a schematic side view of a pre-spooling device with a protective disk arranged rigidly or fixedly on the storage drum.
Figure 3:
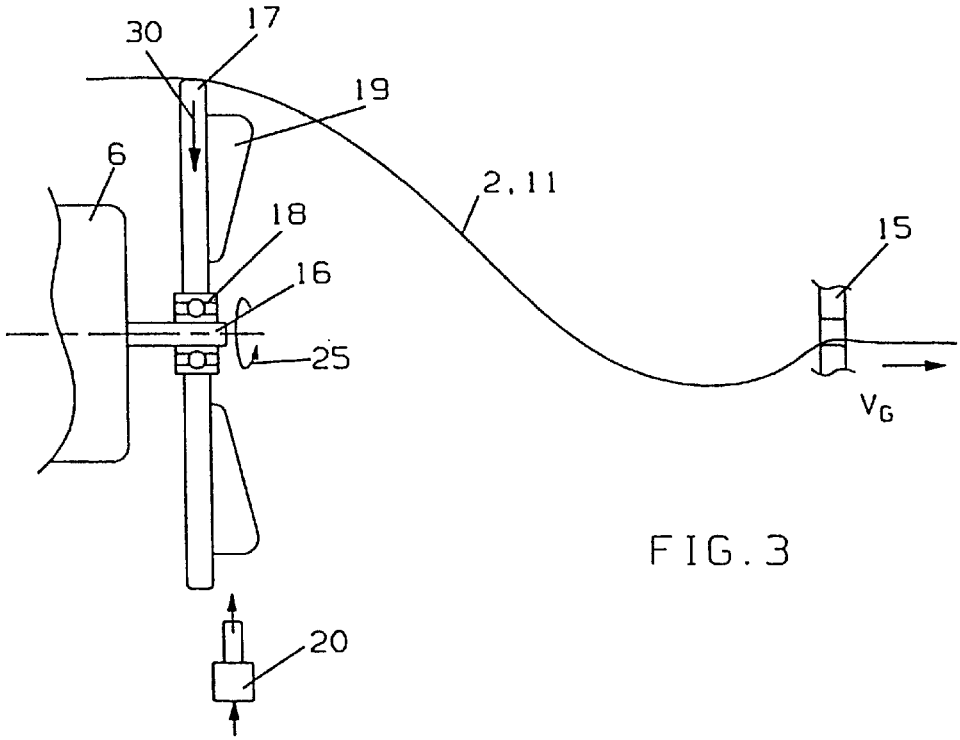
FIG. 3 shows a schematic side view of a first embodiment of a drive arrangement for rotating the protective disk that is rotatably arranged in the pre-spooling device.
Figure 4:
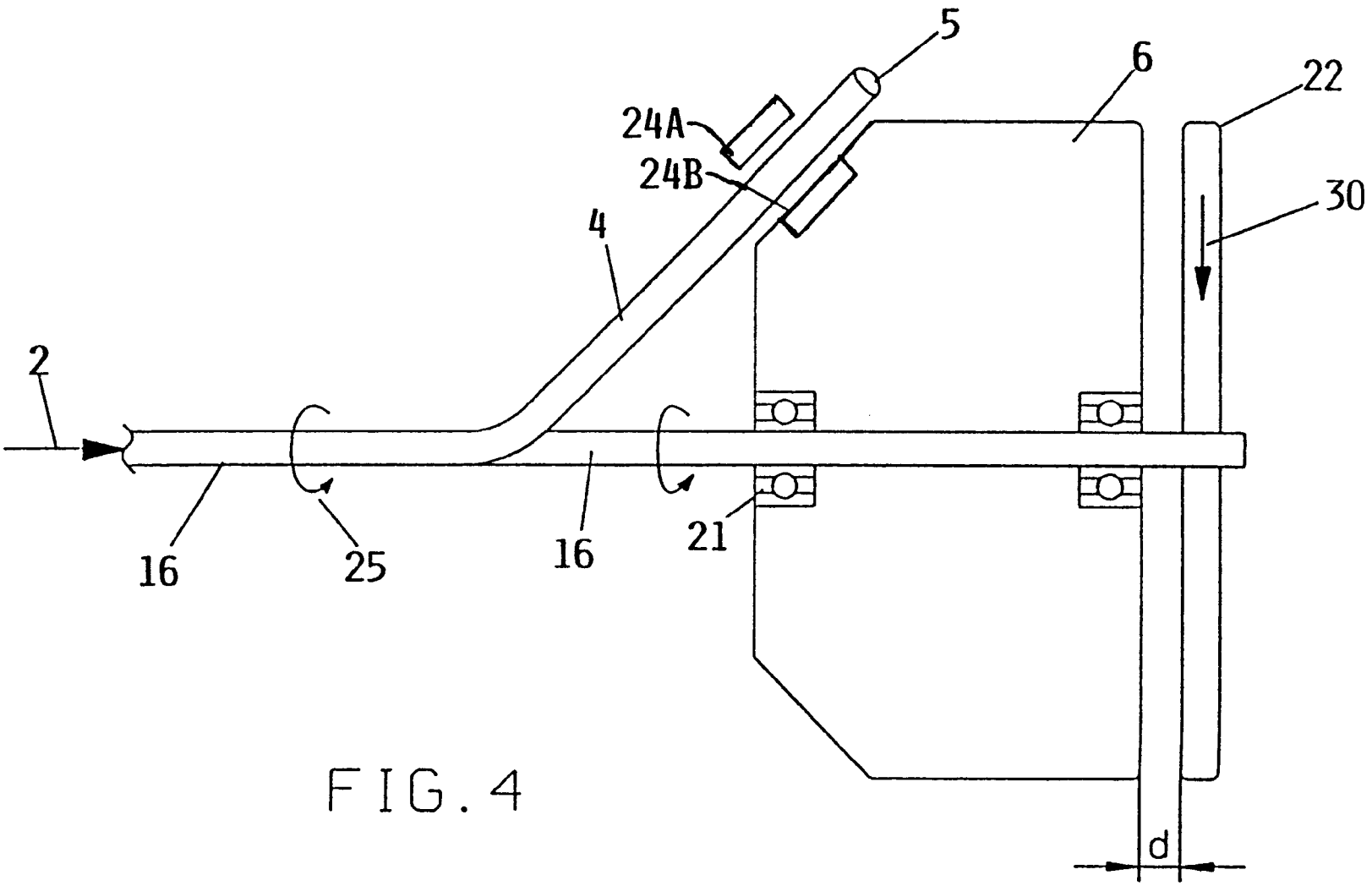
FIG. 4 shows a schematic side view of a second embodiment of a drive arrangement for rotating the protective disk that is rotatably arranged in the pre-spooling device.
Figure 5:
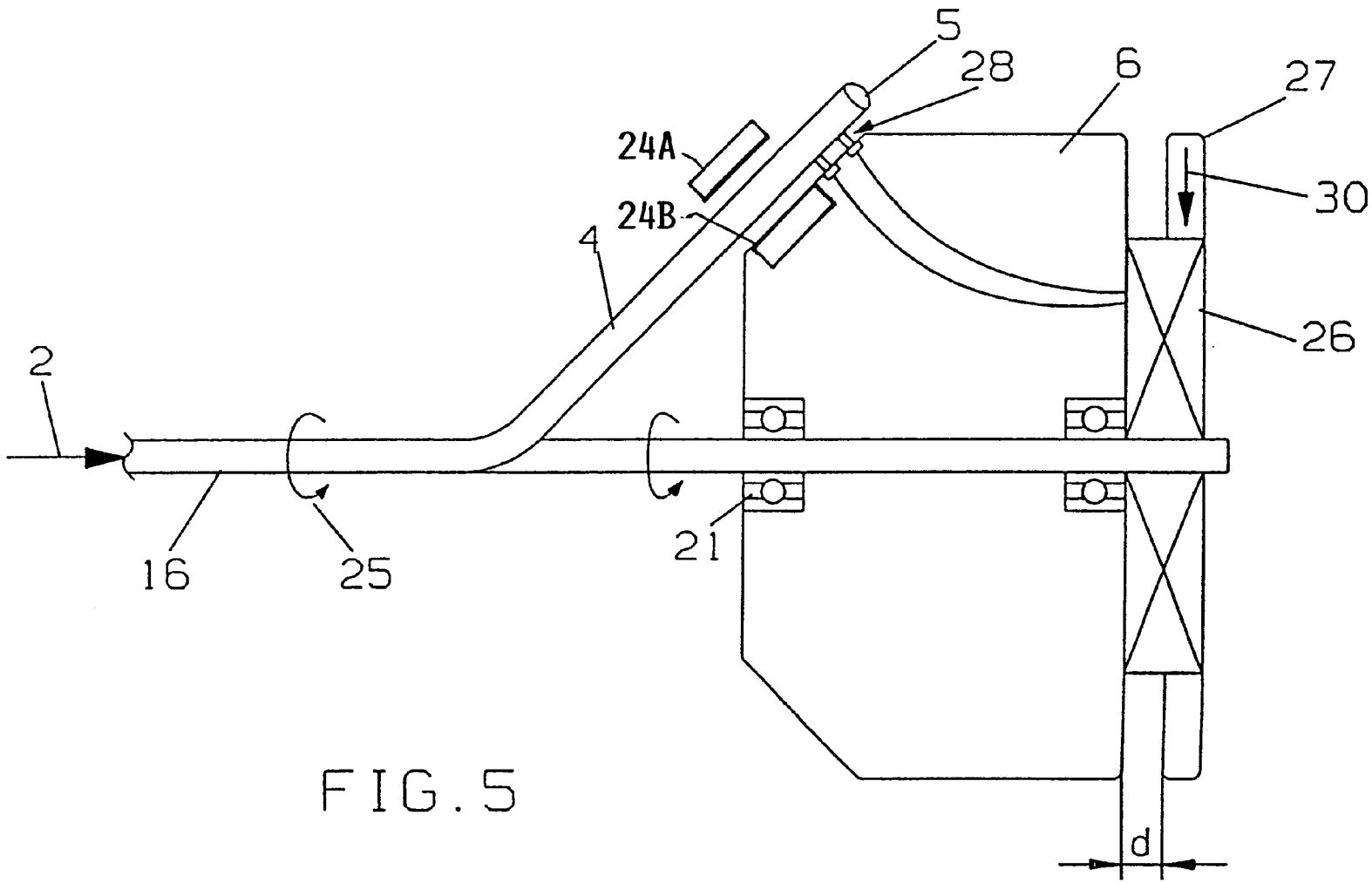
FIG. 5 shows a schematic side view of a third embodiment of a drive arrangement for rotating the protective disk that is rotatably arranged in the pre-spooling device.

FIG. 1 shows the basic construction of a pre-spooling device or pre-winder 1 including a protective disk 10 according to the invention. This pre-spooling device 1 is a component of the weft thread supply arrangement, which further includes a supply spool which is not shown. A weft thread 2 is drawn off from the supply spool (at the left side of FIG. 1) and is then fed into a thread winding guide 4 which is configured internally substantially as a guide tube (see e.g. FIG. 4), which guides the weft thread 2 through the motor housing 3 of the pre-spooling device 1 to the point at which the weft thread 2 emerges out of the thread guide eyelet 5 of the thread guide 4. The thread guide 4 is rotatingly driven in the rotation direction 25 and is connected to or substantially forms a part of a drive shaft 16 that is shown in FIGS. 3 to 5.

The pre-spooling device 1 further includes a thread storage drum 6 that is arranged on the drive shaft 16, but in such a manner so that the drum 6 itself does not rotate. The rotating thread guide 4 with its thread guide eyelet 5 serves to wind up the weft thread 2 onto the non-rotating drum 6. The drum 6 is made up of several drum segments 7, which are distributed about the circumference of the drum. The diameter and circumference of the drum 6 can be changed or adjusted by radially slidingly adjusting the several drum segments 7. The structural arrangements or mechanisms for achieving such radial adjustability of the drum segments 7 are known in the art, and can be carried out in any known manner. Respective open gaps or interspaces 8 remain between the respective neighboring drum segments 7, whereby each interspace 8 becomes larger or smaller depending on the particular radial position in which the drum segments 7 are arranged. So-called separating bails 9 are arranged respectively on each drum segment 7. These separating bails 9 serve to ensure that the weft thread 2 that is wound up on the drum 6 is transported from the upstream thread guide side of the drum 6 (i.e. the left side of the drum 6 in FIG. 1) to the downstream or drawing-off side of the drum opposite thereto (i.e. the right side of the drum 6 in FIG. 1). Then the weft thread 2 is drawn off from the drum 6 through a drawing-off eyelet 15, from which the thread is then inserted into the loom shed of the loom (not shown) by the weft insertion nozzle 29. The drawing-off eyelet 15 may either be a passive simple eyelet, or may be an active nozzle provided with a pressure medium for actively drawing the thread 2 off of the drum 6.

When the weft thread 2 is being drawn off from the drum 6, the thread 2 forms a so-called thread balloon 11 defined by the thread 2 unwinding circumferentially from the drum 6 and traveling in the drawing-off direction to form a substantially conical surface of revolution defined by the compound motion of the moving thread 2. The size or diameter of this thread balloon 11 depends on the quality of the yarn or thread being used, and other parameters, which effect the aerodynamic and inertial characteristics of the thread, for example. In order to reduce or limit the extent of formation of the thread balloon 11 between the drum 6 and the drawing-off eyelet 15, and to thereby improve the drawing-off behavior of the thread, a so-called balloon breaker or anti-ballooning device 14, for example in the form of a conical funnel, is arranged between the drum 6 and the drawing-off eyelet 15 in a generally known manner. The anti-ballooning device or balloon breaker 14 can be slidably arranged on a bracket 13 that extends from the motor housing 3 or the like. A measuring module 12, which measures the length of thread 2 being stored and then drawn off from the drum 6 by any known means, may also be arranged on this bracket 13 or an extension arm connected thereto.

Figure 2:
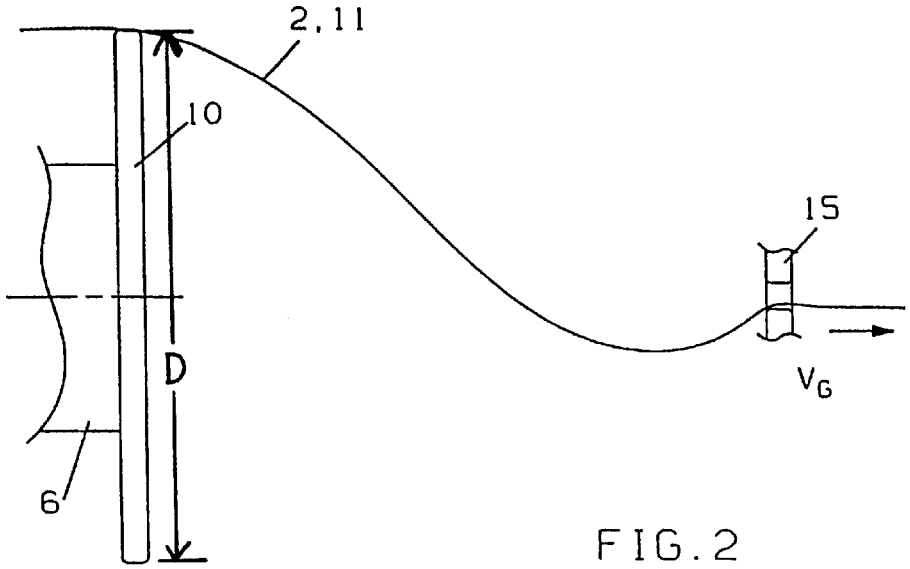
FIG. 2 shows a section through the protective disk arranged rigidly on the drum according to FIG. 1.

As shown in FIG. 1, and in an enlarged simplified manner in FIG. 2, a protective disk 10 is arranged between the drum 6 and the balloon breaker 14 or the drawing off eyelet 15. The protective disk 10 is generally adjacent to the downstream end of the drum 6. Throughout this specification, the term "adjacent" means directly adjoining or closely next to, while allowing for some space between two "adjacent" components. The outer diameter D of the protective disk 10 approximately corresponds to the adjusted diameter of the drum 6, i.e. of the drum segments 7. Note that the radially adjustable drum segments 7 are not shown in FIG. 2, but rather only the fixed hub of the drum 6 is shown. The diameter relationship between the protective disk 10 and the adjusted diameter of the drum segments 7 can be seen in FIG. 1. In this context, the diameters being approximately equal means, for example, that the difference between the diameters is no more than 10% and preferably no more than 5% of the diameter D. In this context, preferably the diameter of the protective disk 10 is the same as or slightly larger than the adjusted diameter of the drum segments 7, but is preferably not smaller than the adjusted diameter of the drum segments 7.

Figures 6A, 6B, 6C:
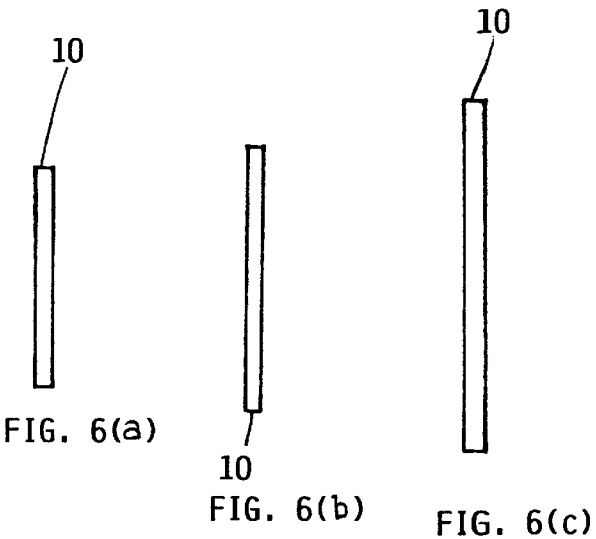
FIGS 6(*a*)–6(*c*) shows several replacement disks that have different diameters and can be used exchangeably as the protective disk.
Figure 7:
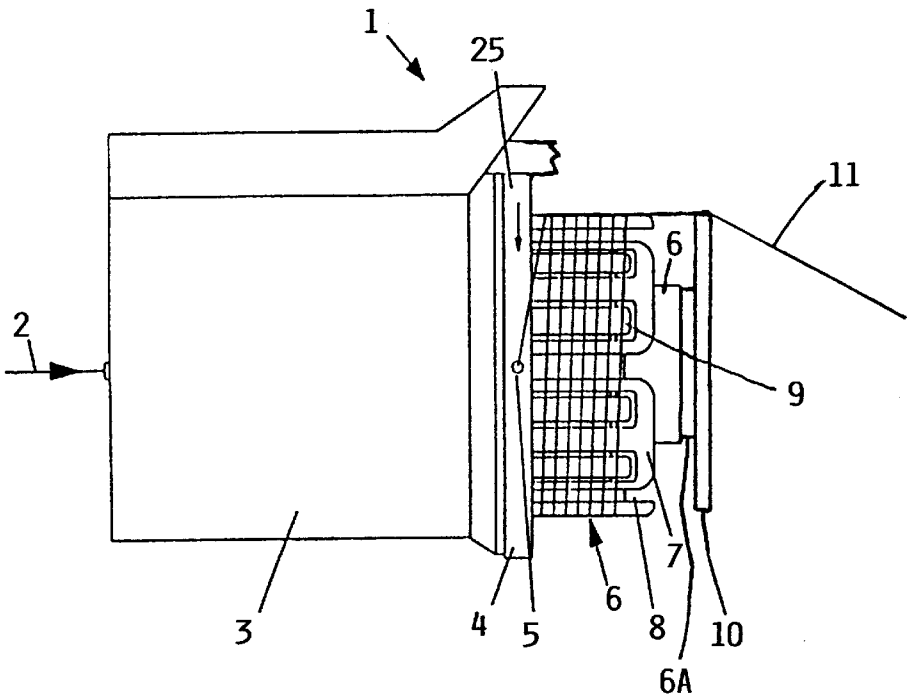
FIG. 7 is similar to a portion of FIG. 1 but shows a different axial spacing distance between the drum segments and the protective disk.

In the example according to FIGS. 1 and 2, the protective disk 10 is arranged directly on the drawing-off side endface of the drum 6. The protective disk 10 thus remains stationary with the drum 6. With this arrangement, the weft thread 2 is drawn off from the drum 6 over the circumferential edge of the protective disk 10 and then through the drawing-off eyelet 15, whereby the protective disk 10 prevents the weft thread 2 from penetrating into the gaps or interspaces 8 between the drum segments 7 during the drawing-off thereof, which would otherwise interfere with the drawing-off process. The protective disk 10 is releasably and exchangeably mounted on the drum 6 (for example by screws, bolts, clamps, clips or the like, which are not shown) so that the respective protective disk 10 may be exchanged with a selected protective disk of a different diameter, among a kit of several disks 10 with different diameters (FIGS. 6(*a*)–6(*c*), so as to match the diameter of the disk to the adjusted diameter of the drum 6, i.e. of the drum segments 7. Also, the axial spacing distance between the drum segments 7 and the protective disk 10 can be adjusted as needed to achieve the desired thread guiding or protective effect, by inserting a proper number or combined cumulative thickness of spacer elements or shims 6A between the hub of the drum 6 and the protective disk 10 (see FIG. 7 with a larger axial spacing distance compared to FIG. 1).

In order to reduce the additional arising frictional resistance between the weft thread 2 and the outer edge of the protective disk 10, the circumferential edges of the protective disk 10 are rounded off, as shown in the drawings. Moreover, the particular surface characteristic of the circumferential edges of the protective disk 10 can be adapted or matched to the quality of the yarn or thread that is to be processed. In other words, the surface of the edge of the protective disk 10 may be made very smooth or rough, or may be provided with a smoothness or roughness characteristic between very smooth and very rough.

A second embodiment provides that the protective disk 10 is arranged to rotate about its center axis, preferably being self-driven, in order to further reduce the frictional resistance between the weft thread 2 and the outer circumferential edge of the protective disk 10. Several variations for such a rotationally driven arrangement of the protective disk 10 will now be described in connection with corresponding figures.

FIG. 3 shows an embodiment of a protective disk 17 that is rotatably mounted on an end of the drive shaft 16 protruding from the drum 6, whereby the drum 6 is also mounted on the drive shaft 16 so as to allow the shaft to rotate freely within the drum. Particularly, the protective disk 17 is supported via a bearing 18 on the drive shaft 16, so that the protective disk 17 can rotate independently of the rotation of the drive shaft 16. In order to rotationally drive the protective disk 17, a plurality of wings or vanes 19 are arranged on an endface surface of the disk 17, whereby these wings or vanes 19 extend substantially radially relative to the axis of the shaft 16 and substantially perpendicularly relative to the surface of the disk 17 extending along a radial plane. A blowing nozzle 20 is arranged near the circumference of the disk 17 and is oriented to blow a jet of pressurized air or some other pressure medium onto the wings or vanes 19, in order to rotationally drive the protective disk 17 in the rotation direction 30 which corresponds to the rotation direction 25 of the drive shaft 16. This arrangement provides the advantage, among others, that the rotational speed of the protective disk 17 can be selected and adjusted independently of the rotational speed of the drive shaft 16.

FIG. 4 schematically shows a further variant for rotationally driving a protective disk 22. FIG. 4 shows the drive shaft 16, which partially carries or corresponds with the thread guide 4, and on which the drum 6 (which does not rotate itself) is mounted via antifriction bearings 21. In order to avoid a following rotation of the drum 6 as a consequence of the rotation of the drive shaft 16, strong holding magnets 24A are fixedly arranged on a stationary component of the apparatus and cooperate with companion holding magnets 24B mounted on the drum 6. In this manner, the drum 6 is fixedly held in its stationary position by the holding magnets 24A and 24B. A protective disk 22 is fixedly secured onto the drive shaft 16 in the area of the drawing-off side endface of the drum 6. Thereby, the protective disk 22 rotates along with the drive shaft 16 in the rotation direction 30. In other words, in this embodiment, the protective disk 22 is fixedly coupled onto the drive shaft 16 so that it rotates in the same direction and at the rotational speed of the shaft 16. The axial spacing distance d between the drum 6 and the protective disk 22 can be changed or adjusted by appropriately axially positioning the protective disk 22 on the protruding end of the drive shaft 16, whereby this spacing distance d can be adapted to the respective yarn quality being processed.

FIG. 5 shows a further embodiment or variation for rotationally driving a protective disk 27. In this embodiment, an electric motor 26 is arranged on the drum 6, whereby the rotor of this motor 26 carries the protective disk 27 while the stator of this motor 26 is fixed to the drum 6. Thereby, the motor 26 rotates the protective disk 27 in the rotation direction 30, in the same rotational direction or sense as the rotational direction 25 of the drive shaft 16.

Since the main body of the motor 26, e.g. the stator thereof, as well as the drum 6 remain fixed relative to the rotating parts such as the thread guide 4 of the pre-spooling device 1, the power supply for the electric motor 26 is achieved, for example, over slip contacts or sliding contacts 28, which are arranged between the rotating parts of the pre-spooling device 1 and the stationary drum 6. Another variant for providing power in this arrangement would be through the drive shaft embodied as a hollow shaft or tube, whereby respective slip contacts or sliding contacts would then be arranged between the shaft 16 and the electric motor 26. Just like the above described first drive variant, this embodiment for rotationally driving the protective disk 27 also provides the advantage that the rotational speed of the protective disk 27 can be adjusted independently of the rotational speed of the drive shaft 16.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A pre-spooling device for temporarily storing a weft thread for an air jet loom, said device comprising:

a weft thread storage drum, which comprises a plurality of drum segments that are each movably adjustable in a radial direction relative to a center axis of said drum, and which has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom; and a protective disk, which is arranged between said downstream end of said drum and said drawing-off eyelet, and is so configured and adapted so that the weft thread is drawn over a circumferential edge of said protective disk when the weft thread is drawn-off from said drum segments to said drawing-off eyelet;

wherein said pre-spooling device has plural non-rotating components, including said drum which is a non-rotating drum; and wherein said protective disk is rotatably connected to at least one of said non-rotating components so as to be rotatable about a disk axis coincident with said center axis of said drum.

2. A pre-spooling device for temporarily storing a weft thread for an air jet loom, said device comprising:

a non-rotatable weft thread storage drum, which comprises a plurality of drum segments that are each movably adjustable in a radial direction relative to a center axis of said drum, is not rotatable about said center axis, and has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom; and a protective disk, which is arranged between said downstream end of said drum and said drawing-off eyelet, is so configured and adapted so that the weft thread is drawn over a circumferential edge of said protective disk when the weft thread is drawn-off from said drum segments to said drawing-off eyelet, is rotatably drivable to rotate about a disk axis coinciding with said center axis of said drum, and is relatively rotatably connected to and mounted on said drum.

3. A kit comprising said pre-spooling device according to claim 2 and a plurality of additional disks, wherein said protective disk is removably arranged so as to be exchangeable with any selected one of said additional disks.

4. A pre-spooling device for temporarily storing a weft thread for an air jet loom, said device comprising:

a non-rotatable weft thread storage drum, which comprises a plurality of drum segments that are each movably adjustable in a radial direction relative to a center axis of said drum, is not rotatable about said center axis, and has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom; and a protective disk, which is arranged between said downstream end of said drum and said drawing-off eyelet, is so configured and adapted so that the weft thread is drawn over a circumferential edge of said protective disk when the weft thread is drawn-off from said drum segments to said drawing-off eyelet, is rotatably drivable to rotate about a disk axis coinciding with said center axis of said drum, and is fixedly connected to and mounted on said drive shaft so as to rotate therewith.

5. The pre-spooling device according to claim 4, wherein respective interspace gaps are formed between adjacent ones of said drum segments, and wherein said protective disk is so configured, arranged and adapted to prevent the weft thread from entering into said interspace gaps.

6. The pre-spooling device according to claim 4, wherein said protective disk has a disk diameter that is approximately equal to a drum diameter defined by said drum segments about said center axis.

7. The pre-spooling device according to claim 6, wherein said drum diameter is an adjustable diameter dependent on a respective radial adjustment of said drum segments, and said disk diameter is a fixed diameter.

8. A kit comprising said pre-spooling device according to claim 7 and a plurality of additional disks respectively having different diameters, wherein said protective disk is removably arranged so as to be exchangeable with any selected one of said additional disks.

9. The pre-spooling device according to claim 4, wherein said protective disk is movably arranged relative to said drum so that a spacing distance between said protective disk and said downstream end of said drum is adjustable.

10. The pre-spooling device according to claim 4, wherein said circumferential edge of said protective disk is rounded.

11. The pre-spooling device according to claim 4, wherein said circumferential edge of said protective disk is smooth.

12. The pre-spooling device according to claim 4, wherein said circumferential edge of said protective disk is rough.

13. The pre-spooling device according to claim 4, wherein said circumferential edge has a degree of surface roughness that is adapted to and dependent on a characteristic of the weft thread.

14. The pre-spooling device according to claim 4, wherein said drum is rotatably mounted on said shaft to allow said shaft to rotate relative to said drum, and further comprising holding magnets arranged to hold said drum stationary as said shaft rotates.

15. The pre-spooling device according to claim 4, wherein said protective disk consists essentially of a light metal.

16. The pre-spooling device according to claim 4, wherein said protective disk consists essentially of a polymer with a hard coating on a surface thereof.

17. A pre-spooling device for temporarily storing a weft thread for an air jet loom, said device comprising:

a weft thread storage drum, which comprises a plurality of drum segments that are each movably adjustable in a radial direction relative to a center axis of said drum, and which has an upstream end and opposite thereto a downstream end;

a rotationally drivable drive shaft;

a thread winding guide which is arranged adjacent to said upstream end of said drum, connected to said drive shaft so as to rotate therewith in a first rotation direction, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom; and a protective disk, which is arranged between said downstream end of said drum and said drawing-off eyelet, is so configured and adapted so that the weft thread is drawn over a circumferential edge of said protective disk when the weft thread is drawn-off from said drum segments to said drawing-off eyelet, and is arranged to be rotatably drivable in said first rotation direction.

18. A pre-spooling device for temporarily storing a weft thread for an air jet loom, said device comprising:

a weft thread storage drum, which comprises a plurality of drum segments that are each movably adjustable in a radial direction relative to a center axis of said drum, and which has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom; and a protective disk, which is arranged between said downstream end of said drum and said drawing-off eyelet, is so configured and adapted so that the weft thread is drawn over a circumferential edge of said protective disk when the weft thread is drawn-off from said drum segments to said drawing-off eyelet, and is arranged to be rotatably drivable with an adjustable rotation speed.

19. The pre-spooling device according to claim 18, wherein said protective disk is arranged to be rotatably drivable independently of said thread winding guide.

20. The pre-spooling device according to claim 18, wherein said protective disk is rotatably drivable to rotate about a disk axis coinciding with said center axis of said drum, and is relatively rotatably connected to and mounted on said drive shaft.

21. A pre-spooling device for temporarily storing a weft thread for an air jet loom, said device comprising:

a weft thread storage drum, which comprises a plurality of drum segments that are each movably adjustable in a radial direction relative to a center axis of said drum, and which has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom;

a protective disk, which is rotatably supported and arranged between said downstream end of said drum and said drawing-off eyelet, includes a disk body and plural vanes arranged on said disk body, and is so configured and adapted so that the weft thread is drawn over a circumferential edge of said disk body when the weft thread is drawn-off from said drum segments to said drawing-off eyelet; and a blowing nozzle arranged adjacent to said protective disk and oriented and adapted to blow a pressure medium at said vanes so as to rotate said protective disk.

22. A pre-spooling device for temporarily storing a weft thread for an air jet loom, said device comprising:

a weft thread storage drum, which comprises a plurality of drum segments that are each movably adjustable in a radial direction relative to a center axis of said drum, and which has an upstream end and opposite thereto a downstream end;

a rotationally drivable drive shaft;

a thread winding guide which is arranged adjacent to said upstream end of said drum, connected to said drive shaft so as to rotate therewith, and adapted and arranged to wind the weft thread onto said drum segments of said drum;

a drawing-off eyelet arranged adjacent to said downstream end of said drum and adapted to have the weft thread drawn-off from said drum segments through said eyelet and to the loom;

a protective disk, which is arranged between said downstream end of said drum and said drawing-off eyelet, and is so configured and adapted so that the weft thread is drawn over a circumferential edge of said protective disk when the weft thread is drawn-off from said drum segments to said drawing-off eyelet; and an electric motor including a first motor part that is rigidly secured to said drum and a second motor part that is rotatable relative to said first motor part and is secured to said protective disk.

* * * * *